US005228324A

United States Patent [19]

Frackiewicz et al.

[11] Patent Number: 5,228,324

[45] Date of Patent: Jul. 20, 1993

[54] METHOD OF BENDING METAL OBJECTS

[75] Inventors: Henryk Frackiewicz; Zygmunt Mucha; Wieslaw Trampoczy ski; Adolf Baranowski; Andrzej Cybulski, all of Warsaw, Poland

[73] Assignee: Polska Akademia Nauk-Instytut Podstawowych Problemow Techniki, Warsaw, Poland

[21] Appl. No.: 773,767

[22] Filed: Oct. 10, 1991

Related U.S. Application Data

[63] Continuation of Ser. No. 489,771, Mar. 5, 1990, abandoned, which is a continuation-in-part of Ser. No. 275,337, Nov. 23, 1988, abandoned.

[30] Foreign Application Priority Data

Nov. 26, 1987 [PL] Poland ..... 269039

[51] Int. Cl.[5] ..... B21D 5/00

[52] U.S. Cl. ..... 72/342.1

[58] Field of Search ..... 72/342.1, 342.5, 342.6; 219/153

[56] References Cited

U.S. PATENT DOCUMENTS

| | | | |
|---|---|---|---|
| 2,428,825 | 10/1947 | Arnoldy | 72/342 |
| 3,550,418 | 12/1970 | Mc Leod | 72/342 |
| 4,120,187 | 10/1978 | Mullen | 72/342 |

FOREIGN PATENT DOCUMENTS

| | | | |
|---|---|---|---|
| 64119 | 4/1984 | Japan | 72/342 |
| 199528 | 10/1985 | Japan | 72/342 |
| 93028 | 4/1987 | Japan | 72/342 |

*Primary Examiner*—Lowell A. Larson
*Attorney, Agent, or Firm*—Horst M. Kasper

[57] ABSTRACT

This present invention solves the problem of bending objects, particularly flat parallel ones, without employing an external force.

The method according to this present invention involves subjecting the material of the object bent to a repetitive, two-phase heating and cooling process.

During the first phase, the material undergoes heating with a concentrated stream of energy causing a thermal effect along the predetermined bending line and a partial plasticizing, melting and flowing out in the region of the bending line.

On the other hand, the material is subjected in the second phase to being cooled at ambient terperature or, additionally, in a stream of a blown air, thereby causing the previously heated material to shrink along fibers in the direction perpendicular to the bending line due to the internal stresses created by the thermal shrinkage of the material in the heated region, and thus the deformation of the material to be permanently changed.

The method is suitable for bending metal objects.

31 Claims, 9 Drawing Sheets

METHOD OF BENDING METAL OBJECTS

This application is a continuation of application Ser. No. 07/489,771, filed Mar. 5, 1990, now abandoned, which is a continuation-in-part of application Ser. No. 07/275,337, filed Nov. 23, 1988, now abandoned.

The subject of this present invention is a method of bending metal objects, such as plates, bars, etc., along straight lines. By this method it is possible to bend objects with constant and varying thickness, and also objects made of brittle materials and of materials with high hardness.

The hitherto known methods of bending objects of such type, being made of metals, involve the plastic deformation of the material of the object being bent by applying external forces appropriate as to size and direction. The bending is effected by means of the bending machines, bending dies and bending presses adapted to that purpose, frequently very powerful.

Elastic compressive and tensile stresses appear in the material bent and they cause the shape to be changed after the operation of the force has ceased. This affects the accuracy of the intended deformation and makes it difficult to control that process.

In addition to the above these stresses cause a decrease in the service life of the bent objects during their operation. The known methods cannot be used for bending brittle as well as high-strength and high-hardness materials.

The purpose of this present invention has been to develop a method of changing the curvature of metal objects, in the way that would not require the application of heavy equipment and, simultaneously, should make it possible to apply a controlled bending precess with a high accuracy of deformation.

The essence of this present invention involves subjecting the objects to the repetitive, two-phase process of heating and cooling the material along a selected line.

In the first phase, the material is subjected to heating with a concentrated stream of energy causing a thermal effect. The heating either takes place simultaneously along the entire line, or the stream of energy is moving along the line at a predetermined speed.

Consequently, the material is locally plasticised and partially melted in the region of the heating line.

The local nature of the action of the stream of energy together with the heating speed cause the material undergo plastic deformation in that region due to the phenomenon of thermal expansion. The heating mentioned is conducted in such a way that the zone of the material in which the deformation occurs reaches a depth smaller than the thickness of the object.

Next, during the second phase, the object is cooled at ambient temperature or, additionally, in a stream of blown gas, so as to reach the condition in which the material ceases to be plastic throughout the entire region. During cooling the previously deformed zone of the material becomes shorter along the fibres perpendicular to the heating lines due to the thermal shrinkage of the material. Since the shrinking fibres of the material form the zone which does not cover the entire thickness of the object, the object bends at an angle along the line of the original heating.

By repeating the above-mentioned operation many times, the object is given the required curvature.

It is recommended that the heating and cooling process take place under a protective gas atmosphere for the purpose of eliminating the harmful effect of air on the heated area. It is advantageous to carry out the heating process by means of a layer of a substance increasing the coefficient of absorption of the stream of energy.

A high-power laser or electron beam is used as the source of energy.

The method as per this present invention makes it possible to bend metal objects without the need of employing external forces. By this method, the curvature of objects can be changed from a distance under the conditions in which the access to that object is impossible. Besides, the same method allows bending of objects made of brittle and high-hardness materials, for which the previously known methods could not be employed.

BRIEF DESCRIPTION OF THE DRAWING

In the accompanying drawings, in which are shown serveral of the various possible embodiments of the present invention.

During the first phase, the material of the object being bent is subject to heating with concentrated stream of energy SE of of laser radiation. Application of the stream of energy SE of laser radiation, moving at speed V along the bending line AA entails a local change in the condition of the material characterised by different properties at depth G.

Within that region, two zones can be observed, the material being liquid in the first zone S1 and plasticised in the second zone S2, with the boundary of the area encompassing the melting and plasticising zones shown with the line U.

Figure 5:
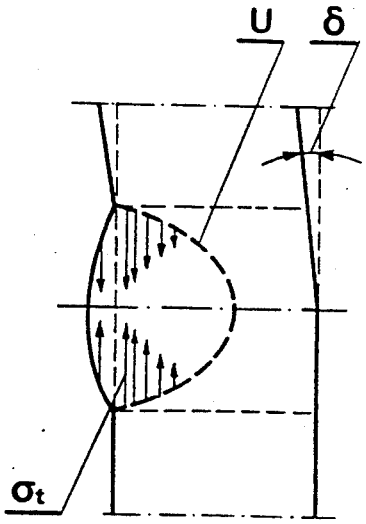
FIG. 5 shows a schematic diagram illustrating the bending process of the embodiment of FIG. 4.

The temperature distribution of the heated material, as shown schematically in FIG. 5 as a function of thickness L of the object indicates additionally the material melting temperature $T_m$. In the heating stage the material of the first, S1, and the second, S2, zones, flows out to occupy an increased volume as a result of the stresses caused by the effect of thermal expansion. This temperature distribution related to melting temperature $T_m$ determines the size of the first, S1, and the second, S2, zones relative to material thickness L.

During the second phase the material is cooled at ambient temperature or, additionally, in the stream of a blown gas. The material within the region of the bending line, i.e. the liquid in first zone S1 and the plasticised material in the second zone, S2, is transformed into solid state. The boundary of the region encompassing the plasticising and melting zone in the heating phase has been marked with line U in FIG. 4.

Figure 6:
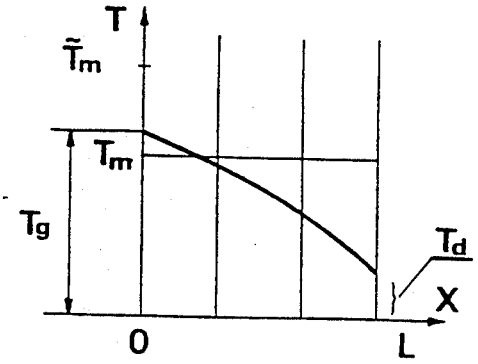
FIG. 6 shows a diagram of a temperature distribution versus depth of a plate during a bending procedure.

Due to internal stresses $\sigma_t$ caused by the shrinkage of the cooled material, it becomes shorter along the fibres marked with arrow, which is shown through the stress distribution along the thickness L of the object in FIG. 6.

In this diagram, the values of limit compression $\sigma_s$ and of limit tensile stress $\sigma_r$ are marked. Should the limit tensile stress, $\sigma_r$, for example, be exceeded, the brittle materials may crack.

The heating and cooling conditions are selected so that the tensile and compressive stresses created in the material should be much smaller than are their limit stresses.

By changing the heating and cooling parameters, such as the stream movement speed, the stream power, the absence or presence, and nature of a layer absorbing the stream of energy, etc., one may affect the temperature distribution in the heating phase [FIG. 5] and the stress distribution in the cooling phase [FIG. 6].

Figure 1A:
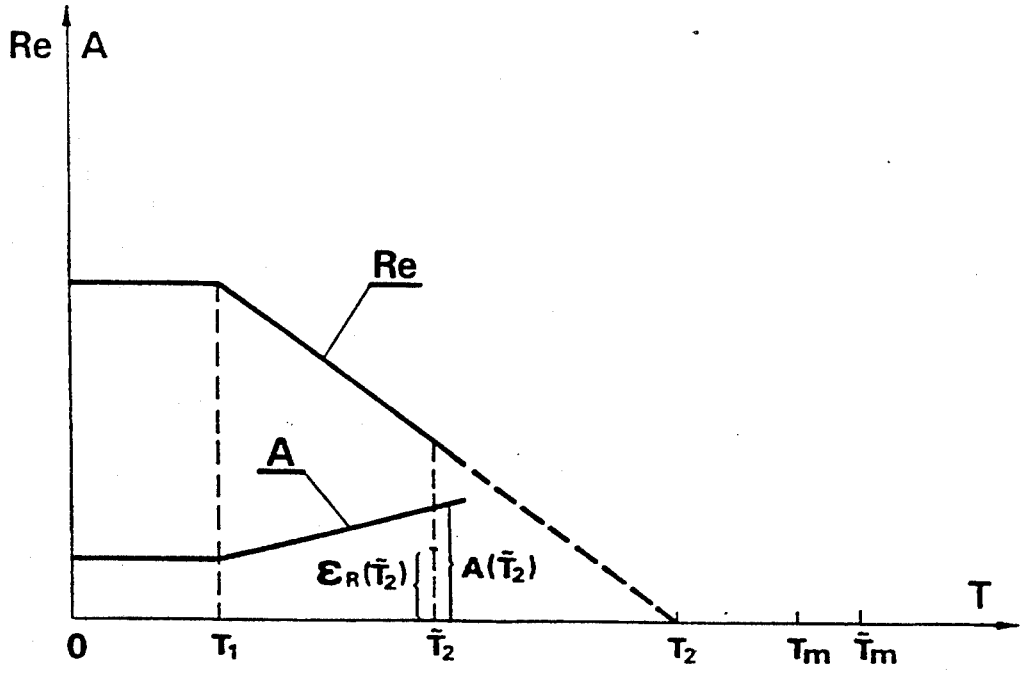
FIG. 1*a* shows a view of a schematic diagram illustrating the plastic stresses Re versus temperature T and the maximum elongation A versus temperature T.
Figure 1B:
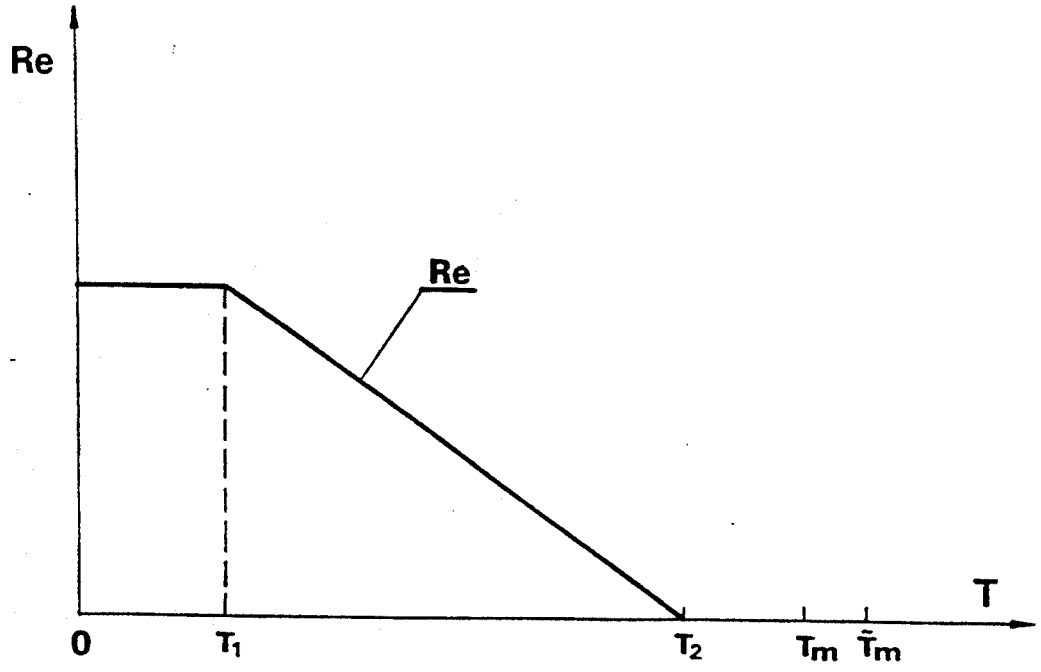
FIG. 1*b* shows a view of a schematic diagram illustrating a simplified model of the plastic stresses Re versus temperature T.
Figure 4:
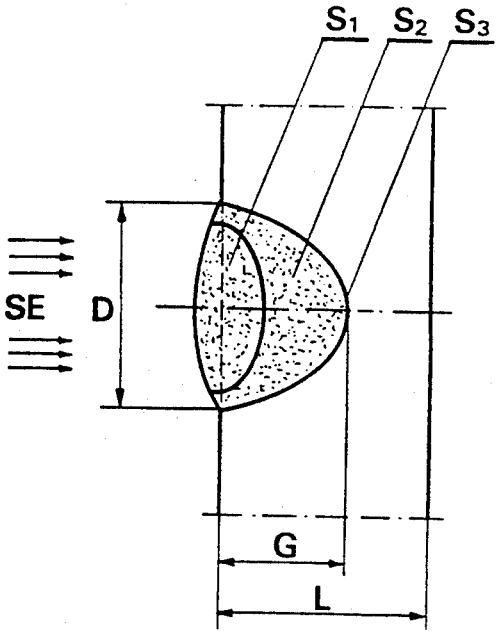
FIG. 4 shows a sectional view of a heating phase of the plate to be bent.

In the above-mentioned manner, control is exercised on the magnitude of the stresses created in the material in order to obtain the desired angle $\delta$ of bending [FIGS. 1 and 4] during one cycle of heating and cooling along the bending line. In one of the possible embodiments, a flat parallel slab shown in FIGS. 1 and 2 has been subjected to a process of bending according to this present invention. The slab, 0.7 mm thick and 20 mm wide, is made of 50 HSA steel and heated with a radiation beam of a continuously operating 300 W $CO_2$ laser, the source of energy moving along line AA [FIG. 2] at the speed of 2.5 cm/sec. The beam is directed perpendicularly to the surface of the slab.

The heating takes place under a protective argon atmosphere. The slab was cooled in the ambient atmosphere within about 1 second. With such conditions of the method employed and after a single heating and cooling cycle, the slab was bent at the angle of 2.8°.

The method of bending objects according to this present invention, can be used for shaping objects of brittle or high-strength materials. Besides, this method can be employed for shaping objects when access to them is difficult, e.g. under vacuum or under hazardous conditions [high tension, harmful radiation, etc.].

We claim:

1. A method of bending metal objects along straight lines comprising selecting a metal object having a flat portion; defining on the flat portion a straight line to represent a bending line on a first side of the flat portion;

heating the flat portion on the first side of the flat portion along said straight line with a concentrated stream of laser beam energy thereby heating the first side of the flat portion in a region of the straight line to a temperature above a melting point of the metal object and thus causing the metal object to be plasticized, melted and in a flowing state within a region adjacent to the bending line on the first side;

cooling the metal object to an ambient temperature in a stream of a gas thereby causing freezing of the metal object precedingly plasticized, melted and in a flowing state thereby contracting and shortening the metal object in a direction perpendicular to the bending line based on internal stresses originated by a thermal shrinkage of the material in the heated region along the bending line on the first side causing the metal object to deform permanently around the bending line causing a surface shrinkage on the first side.

2. The method according to claim 1 further comprising generating a liquid first zone along the bending line and a plasticized second zone surrounding the liquid first zone.

3. The method according to claim 1 further comprising flowing material out of the first side to occupy an increased volume.

4. The method according to claim 1 further comprising blowing a stream of gas against the first side for acceleration of cooling.

5. The method according to claim 1 wherein the concentrated stream of laser beam energy is furnished by a focussed laser radiation beam.

6. The method according to claim 1 wherein the heating is performed in part with a concentrated high-power electron beam.

7. The method according to claim 1, wherein the material is brought up to the plasticizing and melting state to depth G smaller than a thickness L of the flat portion of the metal object.

8. The method according to claim 1, wherein the first side of the flat portion is deformed by the heating to exhibit a concave curved surface.

9. The method according to claim 1, wherein the concentrated stream of energy is directed perpendicular to the first surface.

10. The method according to claim 1, wherein the concentrated stream of energy is directed only onto the first surface and not to a second outer surface of the metal object disposed opposite to the first surface.

11. A method of bending metal objects along straight lines comprising heating a material of an object having a surface to be bent with a concentrated stream of laser beam energy causing a thermal effect along a predetermined bending line and thereby at least in part plasticizing and melting the material in a region adjacent to the predetermined bending line;

cooling the material to a temperature substantially below the temperature of the plasticized material and thereby causing the heated material disposed on the surface to be bent, to be shortened in the area along the predetermined bending line along lines perpendicular to the predetermined bending line and substantially parallel to the surface of the object due to the internal stresses originated by the thermal shrinkage of the material in a heated region and thereby permanently deforming and changing the conformation of the object.

12. The method according to claim 11, wherein a stream of a blown gas is directed to the predetermined bending line of the surface to be bent during cooling the material.

13. The method according to claim 11, wherein the material is cooled to an ambient temperature.

14. The method according to claim 11, wherein the laser beam energy is provided by a focussed laser radiation beam.

15. The method according to claim 11, wherein the concentrated stream of energy is provided in part by a concentrated high power electron beam.

16. The method according to claim 11, wherein the material is transformed into a plasticized state ranging over a depth G during the heating, wherein the depth G is smaller than a thickness L of the object.

17. The method according to claim 11, wherein the material is transformed into a molten state ranging over a depth G during the heating, wherein the depth G is smaller than a thickness L of the object.

18. The method according to claim 11, further comprising generating a protective atmosphere in the area of the predetermined bending line and thereby preventing an access of air to the region being heated.

19. The method according to claim 11, wherein the material is brought up to the plasticizing and melting state from the surface with a depth G smaller than a thickness L of the flat portion of the metal object.

20. The method according to claim 11, wherein the surface of flat portion is deformed by the heating and cooling to exhibit a concave curved surface.

21. The method according to claim 11, wherein the concentrated stream of energy is directed perpendicular to the surface.

22. The method according to claim 11, wherein the concentrated stream of energy is directed only onto the surface and not to a second outer surface defining a thickness of the object and disposed opposite to the surface.

23. A method of bending metal objects along straight lines comprising heating a material of an object having a surface to be bent with a concentrated stream of laser energy, wherein the concentrated stream of laser energy is directed toward the surface to be deformed to be a more concave surface relative to an initial state prior to the heating, wherein the concentrated stream of energy is directed from the outside of the object and causing a thermal melting effect along a predetermined bending line generating a temperature sufficient to result after a following cooling step into a concave surface of the object in a region adjacent to the predetermined bending line;

cooling the material to a temperature substantially below the temperature of the plasticized and molten material and thereby causing the material to be shortened in the area along the predetermined bending line along lines perpendicular to the predetermined bending line and substantially parallel to the surface of the object due to the internal stresses originated by the thermal shrinkage of the material in a heated region and thereby permanently deforming and changing the conformation of the object.

24. The method according to claim 23 further comprising generating a liquid first zone along the predetermined bending line and a plasticized second zone surrounding the first zone.

25. The method according to claim 23 further comprising blowing a stream of gas against the surface for acceleration of cooling.

26. The method according to claim 23 wherein the concentrated stream of laser energy is furnished by a focussed laser radiation beam.

27. The method according to claim 23 wherein the heating is performed in part with a concentrated high-power electron beam.

28. The method according to claim 23, wherein the material is brought up to the plasticizing and melting state to depth G smaller than a thickness L of the flat portion of the metal object.

29. The method according to claim 23, wherein the concentrated stream of energy is directed perpendicular to the first surface and wherein the concentrated stream of energy is directed only onto the first surface and not to a second outer surface of the object disposed opposite to the first surface.

30. A method of bending objects of a vast range of metals, including high strength, hard and brittle ones, by creating inwardly bent, concave plastic hinges along straight lines comprising:

selecting a metal object with a developable first surface having a continuously varying tangent space; defining on said first surface a predetermined straight bending line;

subjecting successive portions of the material in the immediate vicinity of said predetermined bending line on the first surface of the object to a controlled interaction with a concentrated laser beam of radiant energy of a diameter less than about 1.5 times the material thickness and thereby heating the said successive portions to a temperature up to the melting temperature of the metal object, whereby the material becomes plastic and partially molten over a part of its thickness and thus a state of plastic flow is produced in the material within said portions adjacent to the predetermined bending line on the first surface of the object;

cooling the material thereby causing thermal shrinkage and resulting therefrom in a permanent bending around the predetermined straight line thus creating a reentrant angle on the heated surface while preserving a highly uniform thickness of an object wall and of a strength of the material.

31. A method of bending material objects along straight lines comprising heating a material of an object having a surface to be bent with a concentrated stream of laser energy directed toward the surface from the outside of the object and causing a thermal melting effect along a predetermined bending line generating a temperature sufficient to induce a shrinkage of the material in the area of the predetermined bending line upon a cooling of the material resulting then in a concave surface of the object in a region adjacent to the bending line;

cooling the material to a temperature substantially below the temperature of the plasticized and molten material and thereby causing the heated material disposed on the surface to be bent, to be shortened in the area along the predetermined bending line along lines perpendicular to the predetermined bending line and substantially parallel to the surface of the object due to the internal stresses originated by the thermal shrinkage of the material in a heated region and thereby permanently deforming and changing the conformation of the object.

* * * * *

UNITED STATES PATENT AND TRADEMARK OFFICE

CERTIFICATE OF CORRECTION

PATENT NO. : 5,228,324

DATED : July 20, 1993

INVENTOR(S) : Henryk Frackiewicz, et al.

It is certified that error appears in the above-indentified patent and that said Letters Patent is hereby corrected as shown below:

On the title page, item (75) Inventors: delete "Trampoczy ski" and insert --Trampczynski--.

The title page, should be deleted to appear as per attached title page.

The sheets of drawings, consisting of figures 4-7, should be deleted to appear as per attached pages.

Figure 12:
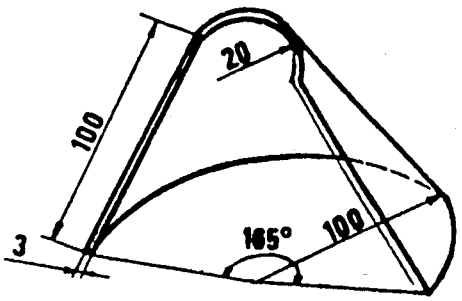
FIG. 12*a* shows a diagram of a circular sector with the dimensions for being bend to a cone sector.
FIG. 12*b* shows a diagram of the cone sector, which diagram is derived from the circular sector as shown in FIG. 12*a*.
Figure 12:
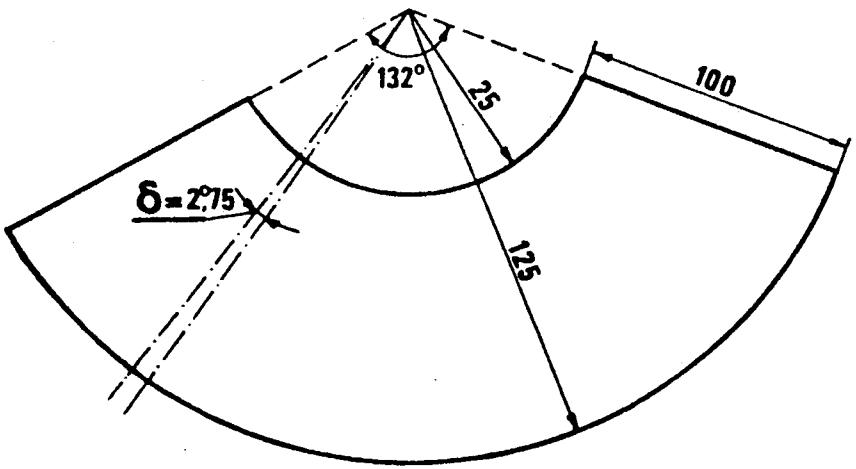
Figure 13:
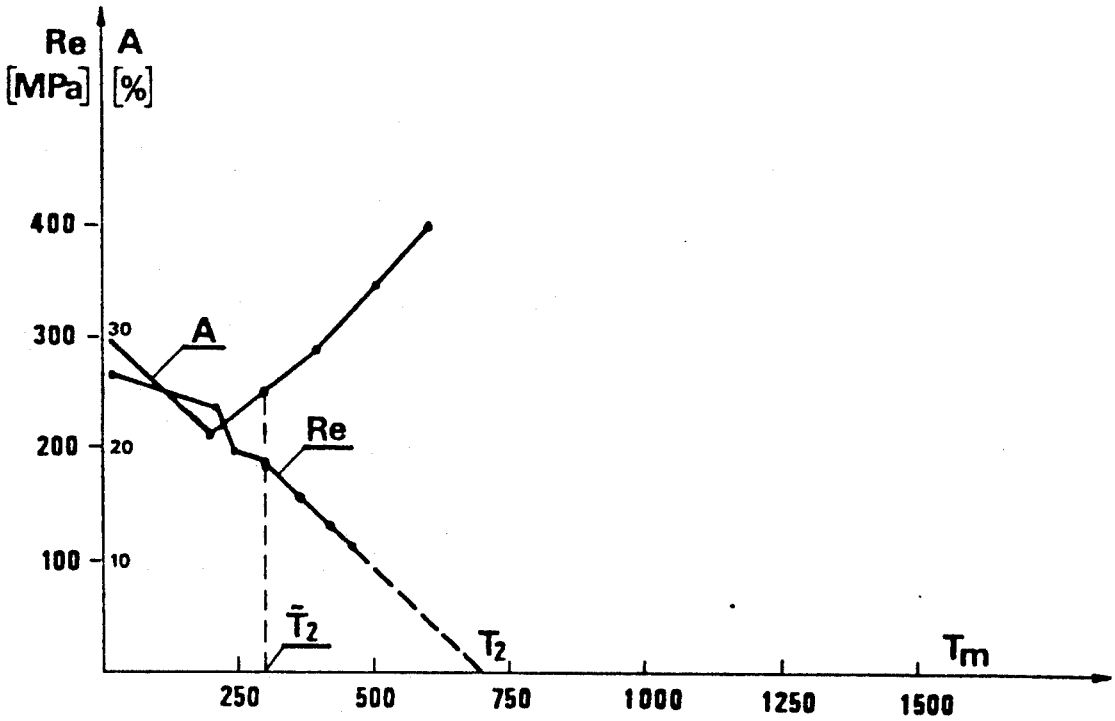
FIG. 13 shows a schematic diagram illustrating the plastic stresses Re versus temperature T and the maximum elongation A versus temperature T.
Figure 4:
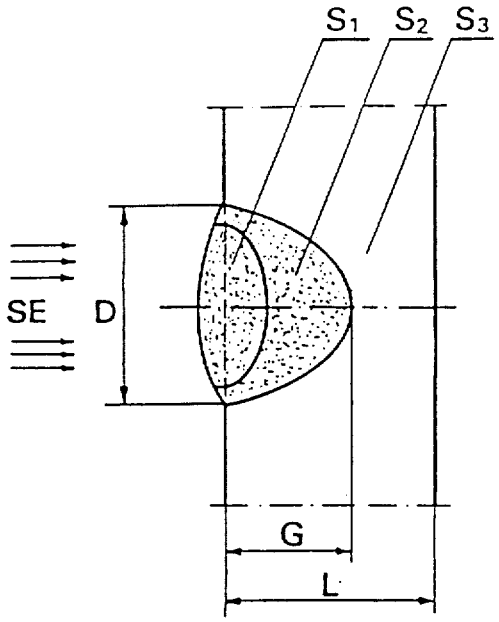
Figure 5:
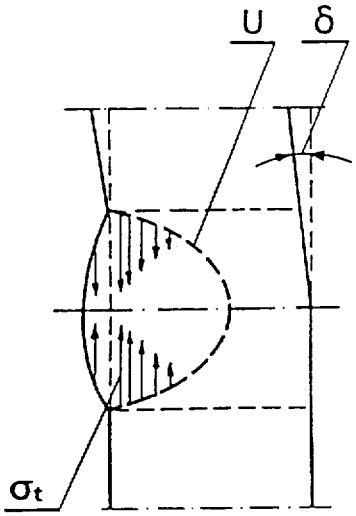
Figure 6:
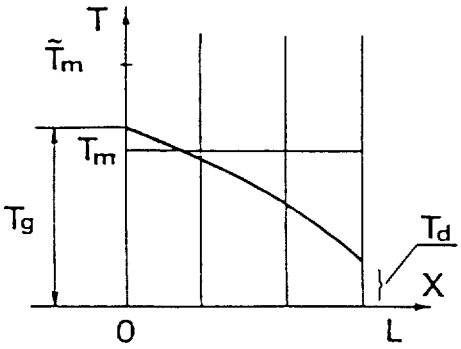
Figure 7:
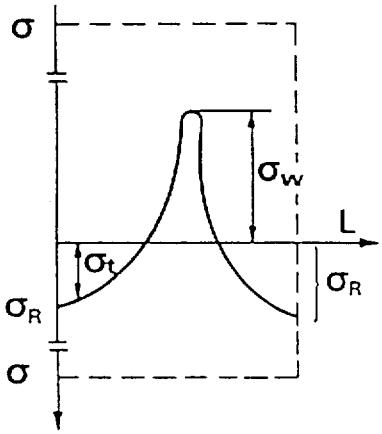
Figure 12:
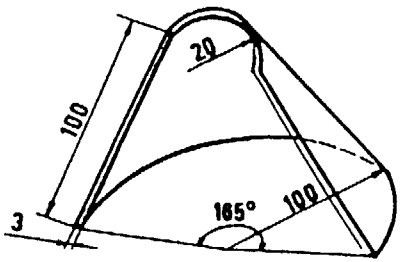
Figure 12:
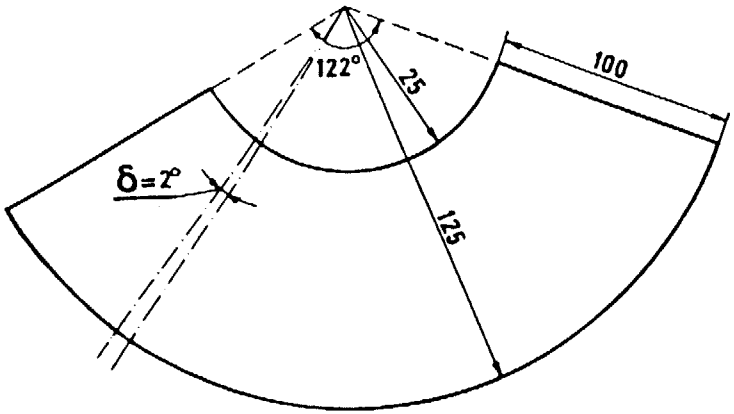

The sheet of drawing, consisting of figures 12a and 12b, should be deletd to appear as per attached page.

Signed and Sealed this

Twenty-eighth Day of June, 1994

*Attest:*

Bruce Lehman

BRUCE LEHMAN

*Attesting Officer*

*Commissioner of Patents and Trademarks*

ıited States Patent [19]
ckiewicz et al.

[11] Patent Number: 5,228,324
[45] Date of Patent: Jul. 20, 1993

METHOD OF BENDING METAL OBJECTS

Inventors: Henryk Frackiewicz; Zygmunt Mucha; Wieslaw Trampoczy ski; Adolf Baranowski; Andrzej Cybulski, all of Warsaw, Poland Assignee: Polska Akademia Nauk-Instytut Podstawowych Problemow Techniki, Warsaw, Poland Appl. No.: 773,767

Filed: Oct. 10, 1991

Related U.S. Application Data

Continuation of Ser. No. 489,771, Mar. 5, 1990, abandoned, which is a continuation-in-part of Ser. No. 275,337, Nov. 23, 1988, abandoned.

Foreign Application Priority Data

. 26, 1987 [PL] Poland ..... 269039

Int. Cl.[5] ..... B21D 5/00
U.S. Cl. ..... 72/342.1
Field of Search ..... 72/342.1, 342.5, 342.6; 219/153

References Cited

U.S. PATENT DOCUMENTS

.428,825 10/1947 Arnoldy ..... 72/342
.550,418 12/1970 Mc Leod ..... 72/342
.120,187 10/1978 Mullen ..... 72/342

FOREIGN PATENT DOCUMENTS 64119 4/1984 Japan ..... 72/342
199528 10/1985 Japan ..... 72/342
93028 4/1987 Japan ..... 72/342

*Primary Examiner*—Lowell A. Larson
*Attorney, Agent, or Firm*—Horst M. Kasper

[57] ABSTRACT

This present invention solves the problem of bending objects, particularly flat parallel ones, without employing an external force.

The method according to this present invention involves subjecting the material of the object bent to a repetitive, two-phase heating and cooling process.

During the first phase, the material undergoes heating with a concentrated stream of energy causing a thermal effect along the predetermined bending line and a partial plasticizing, melting and flowing out in the region of the bending line.

On the other hand, the material is subjected in the second phase to being cooled at ambient terperature or, additionally, in a stream of a blown air, thereby causing the previously heated material to shrink along fibers in the direction perpendicular to the bending line due to the internal stresses created by the thermal shrinkage of the material in the heated region, and thus the deformation of the material to be permanently changed.

The method is suitable for bending metal objects.

31 Claims, 9 Drawing Sheets

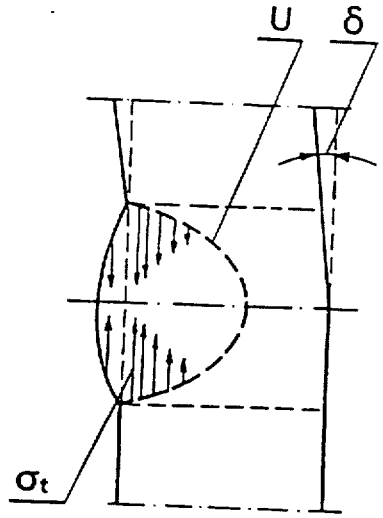

UNITED STATES PATENT AND TRADEMARK OFFICE

CERTIFICATE OF CORRECTION

PATENT NO. : 5,228,324

DATED : July 20, 1993

INVENTOR(S) : Henryk Frackiewicz, et al.

Figure 2A:
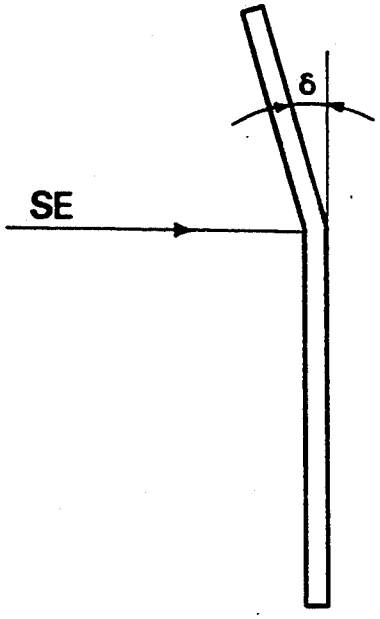
FIG. 2*a* shows a side view of plate being bent.
Figure 2B:
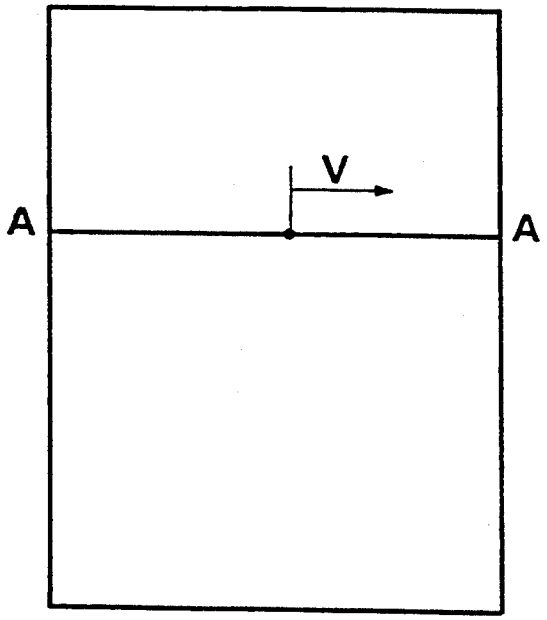
FIG. 2*b* shows a front elevetational view of the embodiment of FIG. 2*a*.
Figure 3:
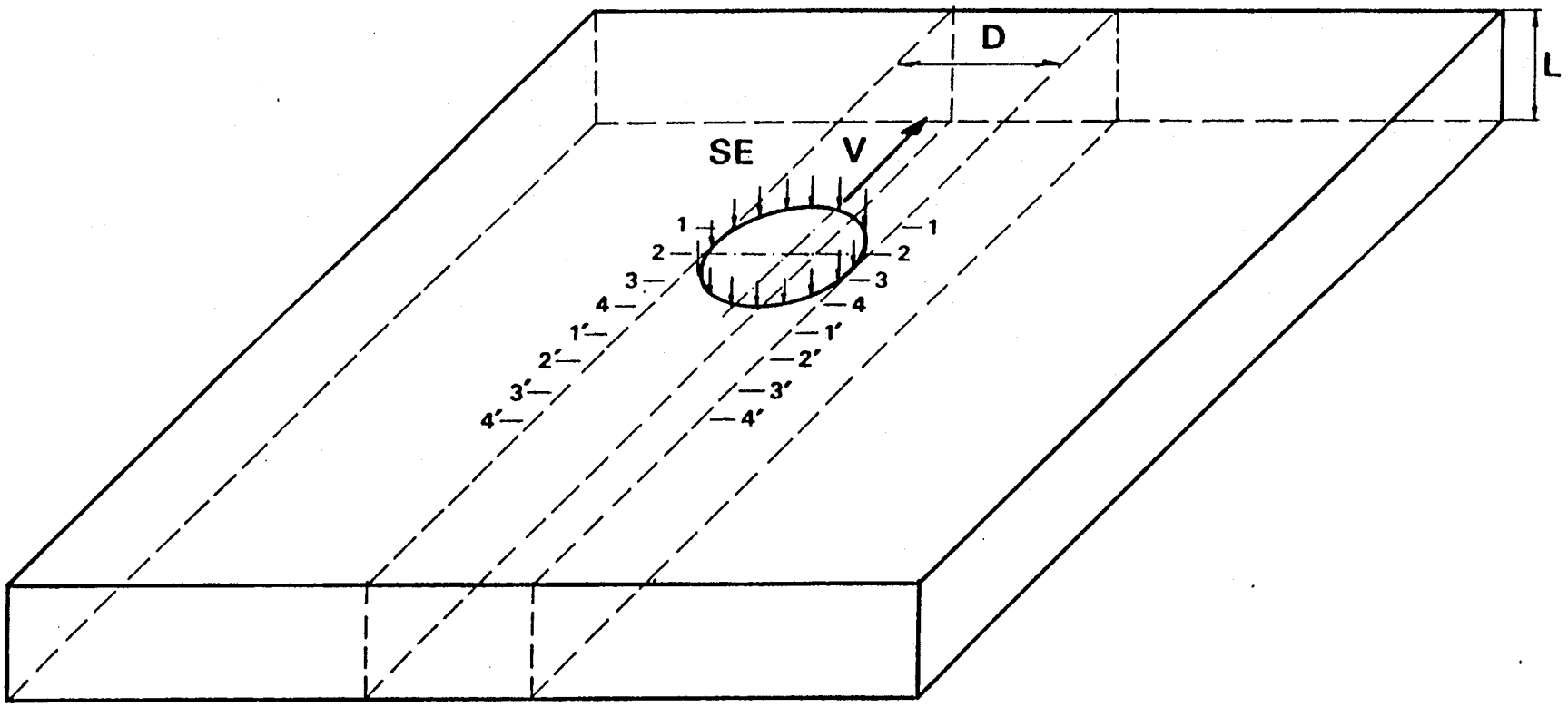
FIG. 3 shows a perspective view of a plate being bent.
Figure 7:
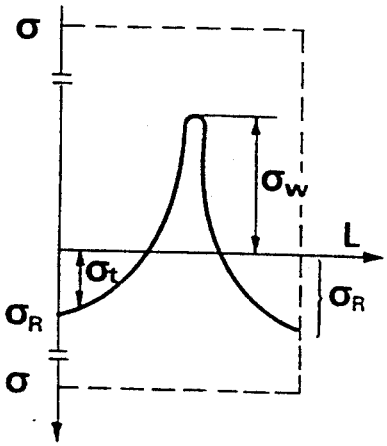
FIG. 7 shows a diagram of plotting stresses versus the depth of the plate during the bending process.
Figure 8:
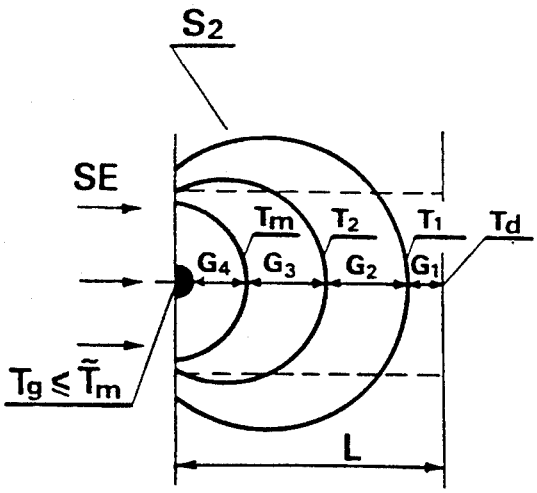
FIG. 8 shows a schematic diagram of a section perpendicular to the plate with a distribution of isotherms illustrating a temperature distribution during bending.
Figure 9A:
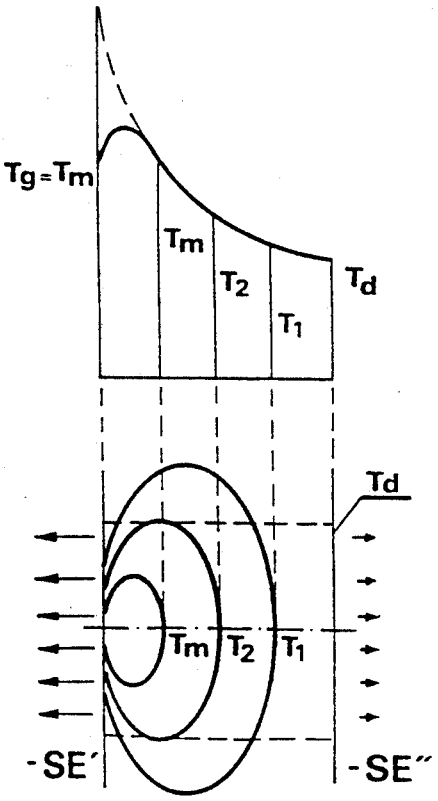
FIG. 9*a* shows a schematic diagram similar to the diagram of FIG. 8 of a section perpendicular to the plate with a distribution of isotherms illustrating a temperature distribution during bending together with a plot of the temperature during bending versus depth location.
Figure 9B:
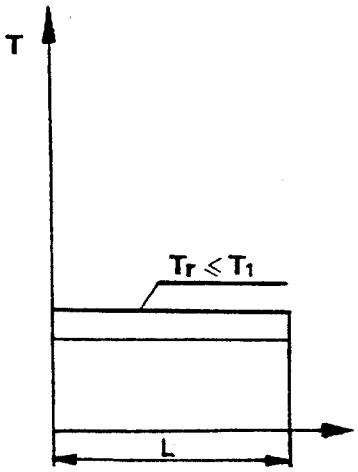
FIG. 9*b* shows a schematic diagram illustrating an isotherm distribution at a cooling stage shown in FIG. 5.
Figure 10:
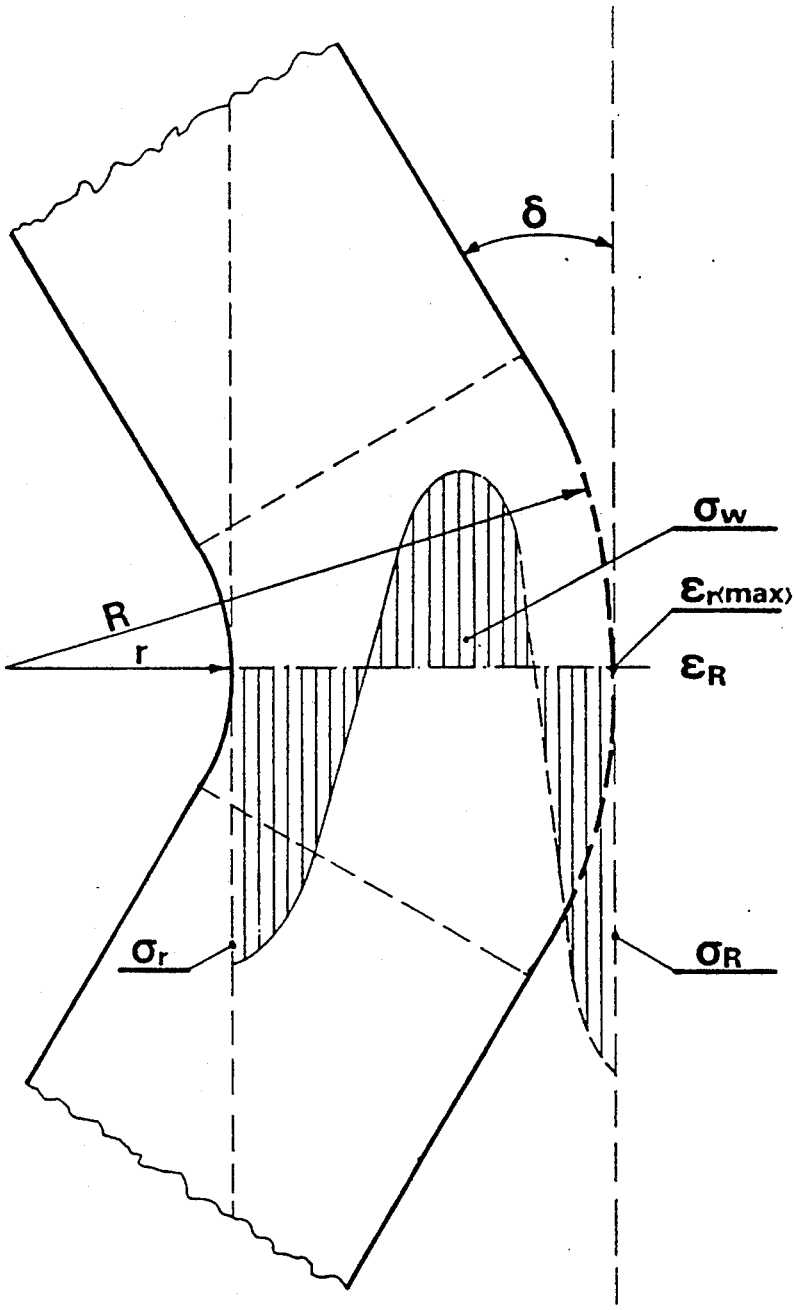
FIG. 10 shows a diagram illustrating a stress distribution within a bent plate.
Figures 11A, 11B:
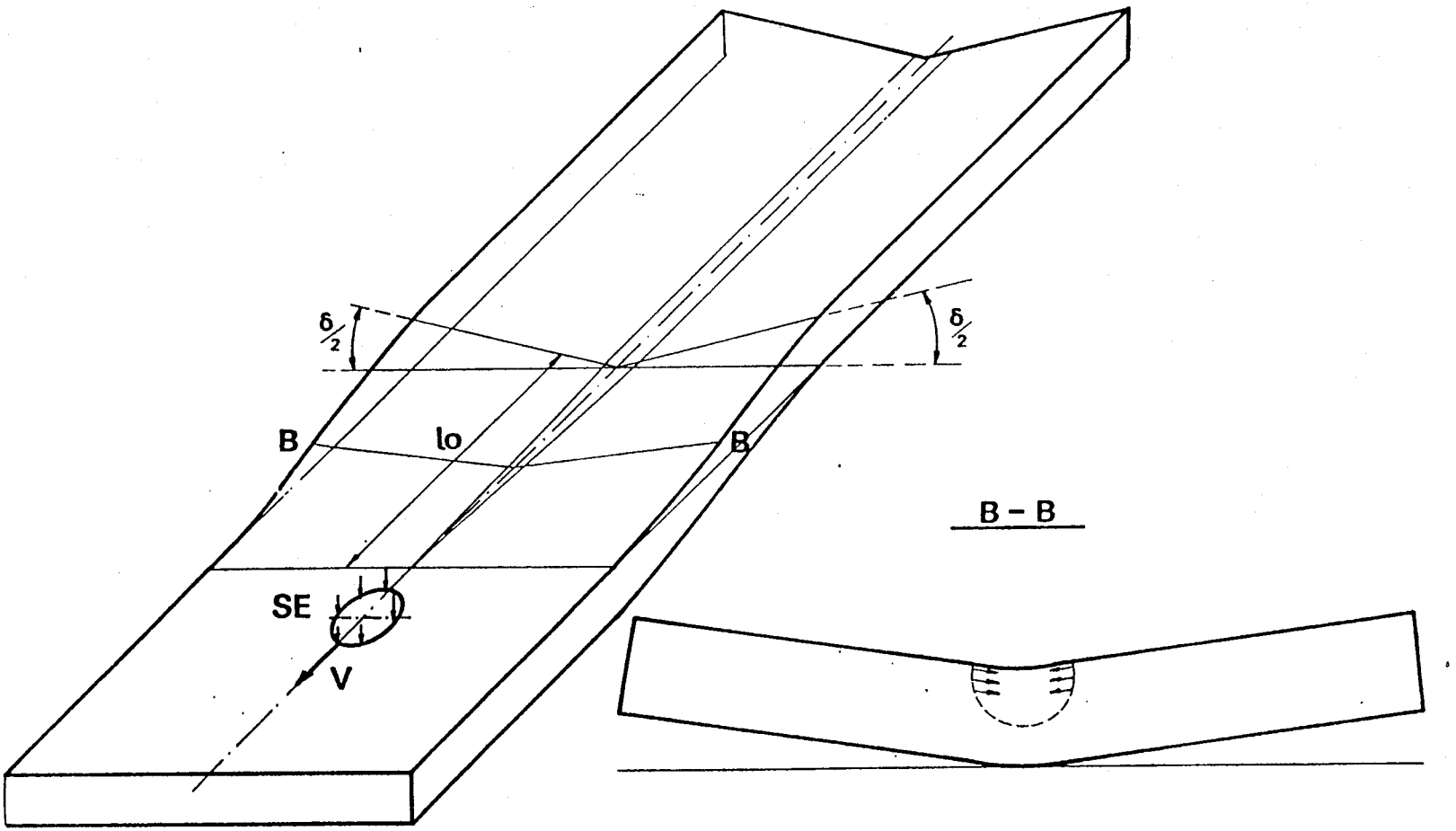
FIG. 11*a* is a perspective view of the bending plate showing the process of bending wherein the energy stream SE is moving along the bending line with the velocity V.
FIG. 11*b* is a sectional view of the bending plate of FIG. 11*a* along the section line B—B.

It is certified that error appears in the above-indentified patent and that said Letters Patent is hereby corrected as shown below:

Column 3, line 14, please delete "FIG. 5" and substitute therefor -- FIG. 6 --;

Column 3, line 30, please delete "FIG. 4" and substitute therefor -- FIG.5 --;

Column 3, line 35, please delete "FIG. 6" and substitute therefor -- FIG. 5 --;

Column 3, line 48, please delete "FIG. 5" and substitute therefor -- FIG.6 --;

Column 3, line 49, please delete "FIG. 6" and substitute therefor -- FIG. 7 --;

Column 3, line 53, please delete "FIGS. 1 and 4" and substitute therefor --FIGS. 2 and 5--;

Column 3, line 55, please delete "FIGS. 1 and 2" and substitute therefor -- FIGS. 2 and 3 --;

Column 3, line 67, please delete "2.8°" and substitute therefor--2°--.